United States Patent [19]

Dahlgren

[11] 4,423,772

[45] Jan. 3, 1984

[54] PLATE HEAT EXCHANGER

[75] Inventor: Jons A. Dahlgren, Lund, Sweden

[73] Assignee: Alfa-Laval AB, Tumba, Sweden

[21] Appl. No.: 294,287

[22] Filed: Aug. 19, 1981

[30] Foreign Application Priority Data

Aug. 28, 1980 [SE] Sweden ..... 8006020

[51] Int. Cl.[3] ..... F28F 3/00

[52] U.S. Cl. ..... 165/166

[58] Field of Search ..... 165/167, 166

[56] References Cited

U.S. PATENT DOCUMENTS 3,469,626 9/1969 Wright et al. ..... 165/166

3,508,607 4/1970 Herrmann ..... 165/166

3,545,062 12/1970 Cox ..... 165/166

3,887,664 6/1975 Regehr ..... 165/166

*Primary Examiner*—William R. Cline

*Assistant Examiner*—John F. McNally

*Attorney, Agent, or Firm*—Cyrus S. Hapgood

[57] ABSTRACT

A heat exchanger comprises a plurality of plates arranged adjacent to each other and provided with mutually corssing corrugation patterns of ridges and grooves which form supporting areas in which the plates abut each other. According to the invention, at least some of the heat exchange passages are defined by plates at least one of which has recessed supporting areas, whereby the volume of the passage is reduced.

3 Claims, 3 Drawing Figures

PLATE HEAT EXCHANGER

The present invention relates to a heat exchanger comprising a plurality of generally rectangular plates arranged adjacent to each other and provided with a turbulence-generating corrugation pattern of ridges and grooves which on adjacent plates extend in different directions in order to form supporting areas in which the plates abut each other.

In this kind of heat exchanger, in which the plates have mutually crossing corrugations, it is known that it is possible to change the flow resistance of the heat exchange passages, and consequently also the so-called thermal length, by varying the press depth and the mutual angle of the corrugations of adjacent plates and by combining various press depths and angles. However, the possibilities of influencing the flow characteristics of the passages are limited to equal variations for both the heat exchanging media. Thus, a change of the passages for one of the media results in a corresponding change of the passages for the other medium.

The above-mentioned limitation constitutes a drawback, since it is sometimes desirable to be able to vary the flow characteristics of the passages for the two media independently of each other, as when the flows of the media are of different magnitude.

To this end, an unsymmetrical corrugation pattern has been proposed having, for example, narrow ridges and wide grooves. By means of such plates, it is possible to provide a heat exchanger in which the passages for the two media have mutually different flow characteristics. The difference in flow characteristics obtained thereby, however, is small, and in addition the area enlargement of the pattern is small. This solution has therefore appeared to be less suitable in practice.

The principal object of the present invention is to provide a plate heat exchanger which makes it possible to vary the flow characteristics of the passages mutually to a generally arbitrary extent and by which the above-mentioned disadvantages of previously known solutions are avoided. This has been obtained by a heat exchanger of the kind initially mentioned which is characterized in that in some of the heat exchange passages at least one of the plates defining the passage has recessed supporting areas, whereby the volume of the passage is reduced.

Figure 1:
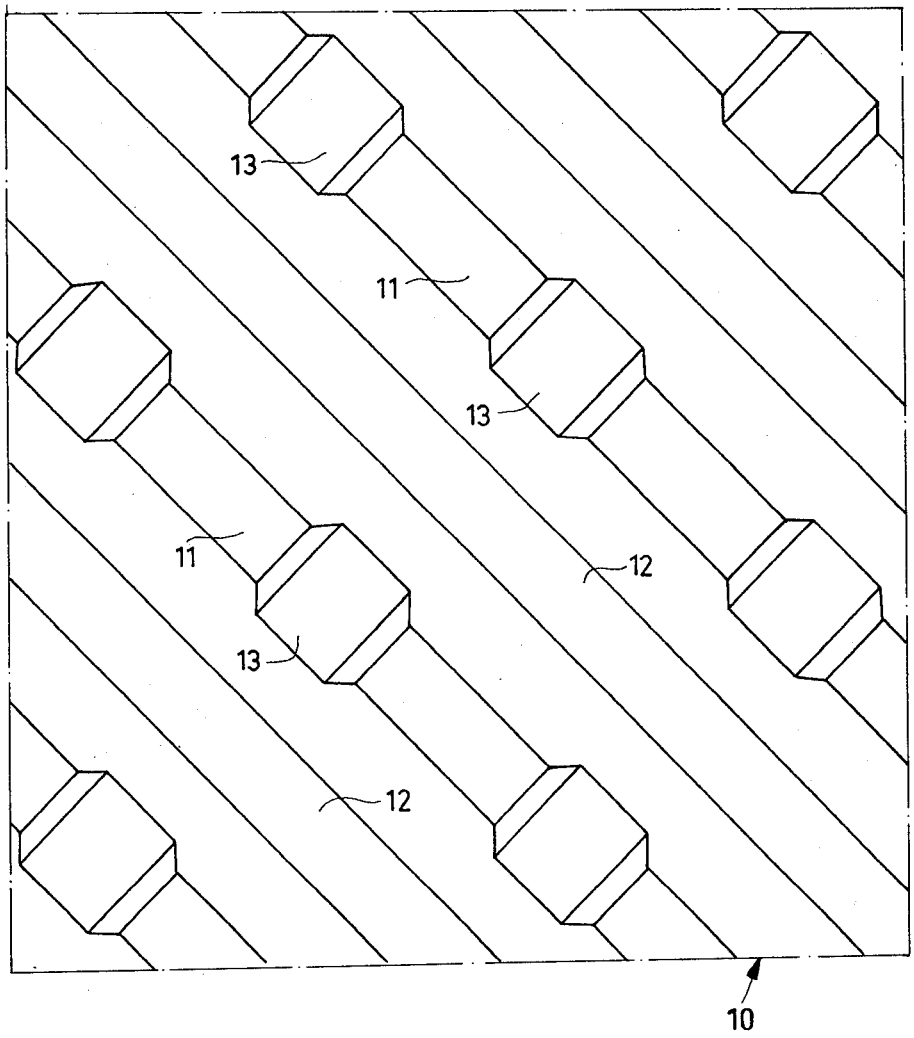
Figure 2:
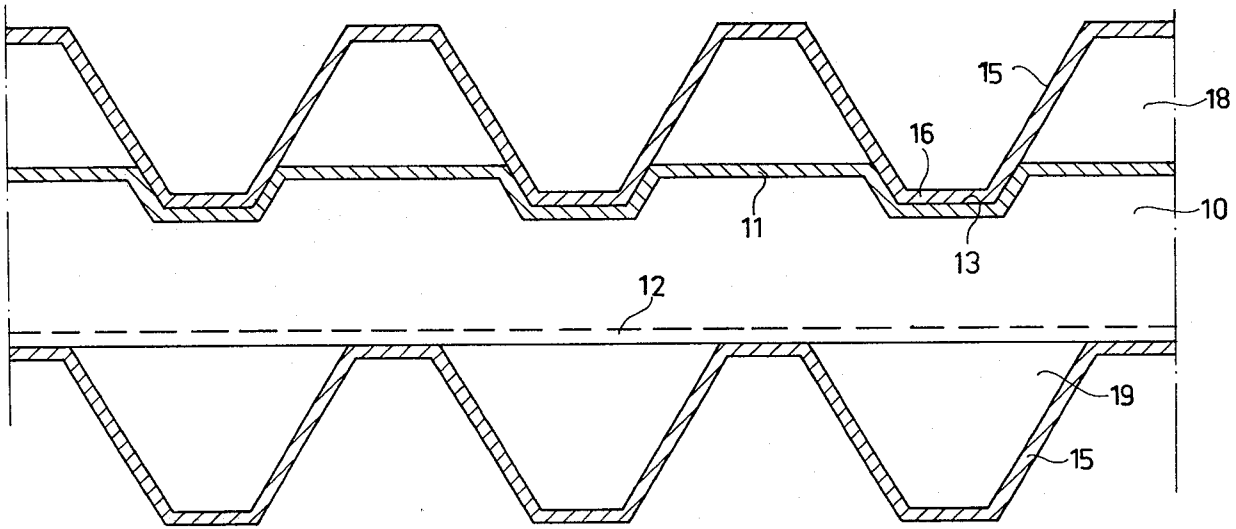
Figure 3:
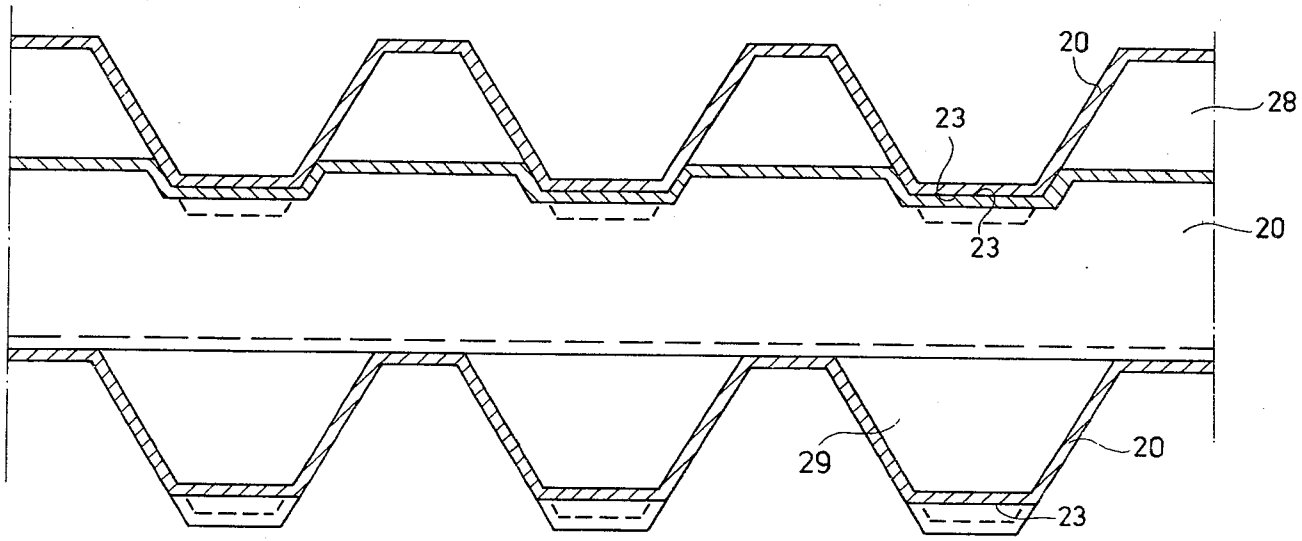

The invention will be described in more detail below with reference to the accompanying drawings, in which FIG. 1 is a partial plan view of a first embodiment of a plate of a heat exchanger according to the invention, and FIGS. 2 and 3 are partial cross-sectional views of different embodiments and combinations of heat exchanging plates.

The plate shown in FIG. 1 is generally designated 10 and is provided with a corrugation of ridges 11 and grooves 12. The ridges 11 are provided with recesses 13 forming supporting areas for an adjacent plate the corrugation of which extends at right angles to the corrugation of plate 10. The mutual angle is arbitrary and that shown is to be considered as an example only.

In the cross-section of FIG. 2, a plate 10 according to FIG. 1 is provided between two conventional plates 15. It then appears that the corrugation grooves 16 of the upper plate 15 abut the recessed supporting areas 13 of the ridges 11 of the plate 10. The volume of the heat exchange passage 18 defined between these two plates is thereby reduced, and consequently the flow resistance thereof is increased. The passage 19 between the plate 10 and the lower conventional plate 15, on the other hand, remains generally unchanged. It is true that the recesses 13 of the ridges of the plate 10 cause a certain reduction of volume even in the passage 19, but this effect is comparatively insignificant.

By disposing plates 10 and 15 alternately, there is provided a heat exchanger having alternating wide and narrow passages and thus having differing flow characteristics for the two heat exchanging media.

FIG. 3 illustrates a combination of three plates 20 all of which are provided with recessed supporting areas 23 on one side. The plates are equal in principle, but every other plate has been turned so that the recessed supporting surfaces abut each other. Due to the fact that the plates are arranged in this way, there are formed on the one hand passages 28 having a substantially reduced volume, and on the other hand passages 29 having a generally normal volume. The difference in flow characteristics of the passages is greater in this case than in the embodiment shown in FIG. 2. In both cases the mutual ratio of the flow resistances of the passages can be controlled by varying the depth of the recesses 13 and 23.

By choosing either of the embodiments in FIGS. 2 and 3 and by countersinking the supporting areas to a suitable extent, the flow characteristics of the passages for the heat exchanging media can be varied mutually within wide limits without appreciably impairing the other properties of the heat exchanger as far as strength and efficiency are concerned.

It is realized that the other abutting areas of the plates must also be countersunk correspondingly. In case rubber gaskets are used for sealing off between the plates, it might also be necessary to reduce the thickness of these.

The invention makes it possible to vary the thermal length of the passages for the heat exchanging media generally independently of each other. It is also possible to combine plates of the different embodiments described above in one and the same heat exchanger. The thermal length of the heat exchanger can thereby, within certain limits, be adapted essentially steplessly to the actual requirement.

I claim:

1. A plate heat exchanger comprising a plurality of generally rectangular plates arranged adjacent to each other to form a flow passage between each pair of adjacent plates, each of said plates having a turbulence-generating corrugation pattern of alternating ridges and grooves which on adjacent plates extend in different directions, the grooves on one side of each plate forming corresponding ridges on the other side of said plate, each ridge on one side of each plate crossing and abutting a plurality of ridges on the opposing side of an adjacent plate to form interplate supporting areas spaced along the length of said each ridge, said supporting areas alternating with unsupported areas spaced along the length of said each ridge, the exchanger being characterized in that in some of said flow passages at least one of the plates defining the passage has said supporting areas recessed in a lower plane in ridges of said one plate, whereby the volumes of said some flow passages are reduced relative to the volumes of the other passages.

2. The exchanger of claim 1, in which in at least a portion of the exchanger only every other plate is provided with said recessed supporting areas.

3. The exchanger of claim 1, in which in at least a portion of the exchanger each plate is provided with said recessed supporting areas.

* * * * *